US009920474B2

(12) United States Patent
Bonner et al.

(10) Patent No.: US 9,920,474 B2
(45) Date of Patent: Mar. 20, 2018

(54) FLAME-RESISTANT FIBER BLEND, YARN, AND FABRIC, AND METHOD FOR MAKING SAME

(71) Applicant: Milliken & Company, Spartanburg, SC (US)

(72) Inventors: Quentin Robert Bonner, Moore, SC (US); Rachel W. Boyette, Taylors, SC (US); John E. Ashley, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 569 days.

(21) Appl. No.: 13/799,336

(22) Filed: Mar. 13, 2013

(65) Prior Publication Data

US 2014/0261852 A1 Sep. 18, 2014

(51) Int. Cl.

| | |
|---|---|
| ***D03D 3/02*** | (2006.01) |
| ***D06P 7/00*** | (2006.01) |
| ***D02G 1/18*** | (2006.01) |
| ***D02G 3/44*** | (2006.01) |
| *D03D 13/00* | (2006.01) |

(52) U.S. Cl.

CPC ..... *D06P 7/00* (2013.01); *D02G 1/18* (2013.01); *D02G 3/443* (2013.01); *D06M 2200/30* (2013.01); *D10B 2201/20* (2013.01); *D10B 2321/101* (2013.01); *D10B 2331/021* (2013.01)

(58) Field of Classification Search

CPC ..... D03D 15/12; D03D 15/00; D03D 1/00; D10B 2331/021; D10B 2201/00; D10B 2321/101; D10B 2331/02; D10B 2401/04; D10B 2501/04; D10B 2201/02; D10B 2201/20; D10B 2401/14; A41D 31/0022; A41D 13/00; B32B 5/02; B32B 5/08; B32B 2250/20; B32B 2262/0269; B32B 2262/04; B32B 2437/00; A62B 17/003; A62B 17/00; D06M 2200/30; D06M 2101/36; Y10S 8/925; Y10S 428/921; Y10S 428/92; Y10S 8/918; Y10S 8/921; Y10S 5/954

See application file for complete search history.

(56) References Cited

U.S. PATENT DOCUMENTS

| | | | | |
|---|---|---|---|---|
| 2,828,228 | A * | 3/1958 | Glade et al. | 442/142 |
| 3,640,823 | A * | 2/1972 | Linderman et al. | 252/608 |
| 4,282,283 | A * | 8/1981 | George et al. | 442/281 |
| 4,533,592 | A * | 8/1985 | Bingham | 428/213 |
| 5,149,582 | A * | 9/1992 | LaMarca et al. | 442/316 |
| 5,506,043 | A * | 4/1996 | Lilani | 442/190 |
| 5,727,401 | A * | 3/1998 | Statham | 66/176 |
| 6,787,228 | B2 | 9/2004 | Campbell et al. | |
| 6,823,548 | B2 * | 11/2004 | Murphy et al. | 5/698 |
| 7,226,877 | B2 * | 6/2007 | Bascom et al. | 442/2 |
| 7,247,585 | B2 * | 7/2007 | Bascom et al. | 442/2 |
| 7,259,117 | B2 * | 8/2007 | Mater et al. | 442/414 |
| 7,393,800 | B2 * | 7/2008 | Corner | 442/302 |
| 7,484,256 | B2 * | 2/2009 | Murphy et al. | 5/698 |
| 7,589,036 | B2 * | 9/2009 | Corner et al. | 442/301 |
| 7,589,037 | B2 * | 9/2009 | Handermann et al. | 442/414 |
| 7,601,414 | B2 * | 10/2009 | Handermann et al. | 428/102 |
| 8,722,145 | B2 * | 5/2014 | Panse et al. | 427/288 |
| 8,732,863 | B2 * | 5/2014 | Hines et al. | 2/81 |
| 2001/0009832 | A1 * | 7/2001 | Shaffer et al. | 442/181 |
| 2002/0142686 | A1 * | 10/2002 | Lapierre | 442/148 |
| 2003/0148689 | A1 * | 8/2003 | Lapierre | 442/327 |
| 2003/0228812 | A1 * | 12/2003 | Stanhope et al. | 442/49 |
| 2003/0232560 | A1 * | 12/2003 | Corner | 442/401 |
| 2004/0060119 | A1 * | 4/2004 | Murphy et al. | 5/698 |
| 2004/0060120 | A1 * | 4/2004 | Murphy et al. | 5/698 |
| 2004/0152378 | A1 * | 8/2004 | Stanhope et al. | 442/5 |
| 2004/0192134 | A1 * | 9/2004 | Gibson et al. | 442/167 |
| 2005/0025963 | A1 | 2/2005 | Zhu | |
| 2005/0079783 | A1 * | 4/2005 | Campbell et al. | 442/181 |
| 2005/0186875 | A1 * | 8/2005 | Lilani | 442/189 |
| 2005/0204718 | A1 * | 9/2005 | Zhu et al. | 57/255 |
| 2005/0208855 | A1 * | 9/2005 | Zhu | 442/302 |
| 2005/0255771 | A1 * | 11/2005 | Chetty et al. | 442/136 |
| 2006/0030228 | A1 * | 2/2006 | Truesdale, III | 442/136 |
| 2006/0040575 | A1 * | 2/2006 | Kelleher et al. | 442/73 |
| 2006/0059634 | A1 * | 3/2006 | Tutterow | 8/478 |
| 2006/0068664 | A1 * | 3/2006 | Gibson et al. | 442/197 |
| 2006/0111000 | A1 * | 5/2006 | Bascom et al. | 442/136 |
| 2006/0135014 | A1 * | 6/2006 | Murphy et al. | 442/304 |
| 2006/0135023 | A1 * | 6/2006 | Knoff | 442/392 |
| 2006/0141880 | A1 * | 6/2006 | Bascom et al. | 442/35 |
| 2006/0160454 | A1 * | 7/2006 | Handermann et al. | 442/415 |
| 2006/0292953 | A1 * | 12/2006 | Ashley et al. | 442/197 |
| 2007/0004302 | A1 * | 1/2007 | McKinnon et al. | 442/136 |
| 2007/0077839 | A1 * | 4/2007 | McKinnon et al. | 442/312 |
| 2007/0224900 | A1 * | 9/2007 | Tucker | 442/181 |
| 2007/0275617 | A1 * | 11/2007 | Harris et al. | 442/59 |
| 2008/0057807 | A1 * | 3/2008 | Tutterow et al. | 442/1 |
| 2008/0085651 | A1 * | 4/2008 | Handermann et al. | 442/404 |
| 2008/0098503 | A1 * | 5/2008 | Swartz | 2/458 |
| 2008/0299854 | A1 * | 12/2008 | Hilleary et al. | 442/136 |
| 2009/0111345 | A1 * | 4/2009 | Panse et al. | 442/138 |

(Continued)

FOREIGN PATENT DOCUMENTS

| | | |
|---|---|---|
| WO | WO-2004/088023 A2 | 10/2004 |
| WO | WO-2006/017709 A2 | 2/2006 |

(Continued)

*Primary Examiner* — Bobby Muromoto, Jr.
(74) *Attorney, Agent, or Firm* — Robert M. Lanning

(57) ABSTRACT

A fiber blend, a yarn spun from the fiber blend, and a fabric made from the yarn, wherein the fiber blend is a blend of staple fibers comprising non-FR cellulosic fibers, modacrylic fibers, and aramid fibers intimately blended together. The blend is such that the cellulosic fibers constitute at least about 45 wt. % of the fiber blend, a weight ratio of the modacrylic fibers to the cellulosic fibers is at least 0.8 but not exceeding 1.0, and the aramid fibers make up no more than 15 wt. % of the fiber blend.

23 Claims, No Drawings

(56) References Cited

U.S. PATENT DOCUMENTS

| | | | | |
|---|---|---|---|---|
| 2009/0178186 | A1* | 7/2009 | Truesdale | 2/455 |
| 2010/0112312 | A1* | 5/2010 | Tutterow et al. | 428/196 |
| 2010/0297905 | A1* | 11/2010 | Ulrich et al. | 442/302 |
| 2010/0298454 | A1* | 11/2010 | Chew et al. | 521/108 |
| 2010/0319850 | A1* | 12/2010 | Panse et al. | 156/327 |
| 2011/0104466 | A1* | 5/2011 | Atkinson | 428/219 |
| 2011/0173734 | A1* | 7/2011 | Mikhail et al. | 2/69 |
| 2011/0183561 | A1* | 7/2011 | Panse et al. | 442/138 |
| 2011/0275267 | A1* | 11/2011 | Smith et al. | 442/301 |
| 2012/0090080 | A1* | 4/2012 | Stanhope et al. | 2/458 |
| 2012/0144794 | A1* | 6/2012 | Ke | 57/90 |
| 2012/0146784 | A1* | 6/2012 | Hines et al. | 340/539.11 |
| 2012/0167269 | A1* | 7/2012 | Hernandez | 2/50 |
| 2012/0171918 | A1* | 7/2012 | Lawson et al. | 442/302 |
| 2012/0183747 | A1* | 7/2012 | Bader et al. | 428/195.1 |
| 2012/0260422 | A1* | 10/2012 | Rock et al. | 5/483 |
| 2013/0022805 | A1* | 1/2013 | Small et al. | 428/220 |
| 2013/0042385 | A1* | 2/2013 | Hines et al. | 2/85 |
| 2013/0055490 | A1* | 3/2013 | Zhu | 2/458 |
| 2013/0064570 | A1 | 3/2013 | Yamane et al. | |
| 2013/0065470 | A1* | 3/2013 | Rock et al. | 442/302 |
| 2013/0152262 | A1* | 6/2013 | Bedetti et al. | 2/16 |
| 2013/0212790 | A1* | 8/2013 | Waxman et al. | 2/458 |
| 2013/0247287 | A1* | 9/2013 | Mizobuchi et al. | 2/455 |
| 2014/0041107 | A1* | 2/2014 | Rose et al. | 2/455 |
| 2014/0075659 | A1* | 3/2014 | Li et al. | 2/458 |
| 2014/0113122 | A1* | 4/2014 | Smith et al. | 428/219 |

FOREIGN PATENT DOCUMENTS

| | | | |
|---|---|---|---|
| WO | WO-2008/027454 | A1 | 3/2008 |
| WO | WO-2012/121759 | A2 | 9/2012 |

* cited by examiner

FLAME-RESISTANT FIBER BLEND, YARN, AND FABRIC, AND METHOD FOR MAKING SAME

BACKGROUND OF THE INVENTION

The present invention relates to flame-resistant fabrics woven or knitted from yarns that are made from fiber blends.

Flame-resistant fabrics (also variously referred to as "fire-resistant", "flame-retardant", and "fire-retardant" fabrics) are fabrics that, once ignited, tend not to sustain a flame when the source of ignition is removed. A great deal of investigation and research has been directed toward the development and improvement of flame-resistant fabrics for use in various products such as bedding, clothing, and others. Flame-resistant clothing is often worn by workers involved in activities such as industrial manufacturing and processing, fire-fighting, electrical utility work, and other endeavors that entail a significant risk of being exposed to open flame and/or electrical arcs.

Flame-resistant fabrics include both fabrics that are treated to be flame-resistant as well as flame-resistant fabrics made from inherently flame-resistant fibers. The former types of fabrics are not themselves flame-resistant, but are made flame-resistant by applying to the fabric a chemical composition that renders the fabric resistant to flame. These types of fabrics are susceptible to losing their flame-resistance when laundered repeatedly because the flame-resistant composition tends to wash out. In contrast, inherently flame-resistant fabrics do not suffer from this drawback because they are made from fibers that are themselves flame-resistant.

Various types of inherently flame-resistant (FR) fibers have been developed, including modacrylic fibers (e.g., PROTEX® modacrylic fibers from Kaneka Corporation of Osaka, Japan), aramid fibers (e.g., NOMEX® meta-aramid fibers and KEVLAR® para-aramid fibers, both from E. I. Du Pont de Nemours and Company of Wilmington, Del.), FR rayon fibers, oxidized polyacrylonitrile fibers, and others. It is common to blend one or more types of FR staple fibers with one or more other types of non-FR staple fibers to produce a fiber blend from which yarn is spun, the yarn then being knitted or woven into fabrics for various applications. In such a fiber blend, the FR fibers render the blend flame-resistant even though some fibers in the blend may themselves be non-FR fibers, because when the FR fibers combust they release non-combustible gases that tend to displace oxygen and thereby extinguish any flame. In such blends, typically there is a greater content of FR fibers than non-FR fibers, on the theory that the flame-extinguishing ability of the FR fibers might be overwhelmed by too much non-FR fiber content.

As an example, United States Patent Application Publication US 2005/0025963 to Zhu discloses an intimate blend of staple fibers having 10 to 75 parts by weight of at least one aramid fiber, 15 to 85 parts by weight of at least one modacrylic fiber, and 5 to 30 parts by weight of at least one polyamide fiber.

Another blend of staple fibers is disclosed in United States Patent Application Publication US 2004/0192134 to Gibson et al. The blend includes at least about 60 percent FR fibers (modacrylic and/or aramid) and up to 40 percent synthetic or natural non-FR fibers such as cotton or wool.

U.S. Pat. No. 6,787,228 to Campbell et al. discloses a yarn formed of a blend of fibers including at least about 70 percent modacrylic fibers combined with at least about 3 percent high-performance, high-energy-absorptive fibers such as aramid.

In the United States, it is desirable and often required for clothing worn by certain types of workers to pass a dual-hazard performance specification encompassing both the flame-resistance standard F1506 of the American Society for Testing and Materials (ASTM) as well as the flash fire protection standard of NFPA 2112-2012. The ASTM F1506 standard, entitled "Standard Performance Specification for Flame Resistant Textiles Materials for Wearing Apparel for Use by Electrical Workers Exposed to Momentary Electrical Arc and Related Thermal Hazards", sets various standard performance specifications for a fabric, among which are specifications for the ability of the fabric to self-extinguish after being ignited. When the ignition source is removed, the fabric must self-extinguish in less than 2 seconds and have less than a 4-inch char length according to ASTM Test Method D6413 ("Standard Test Method for Flame Resistance of Textiles", also referred to as the Vertical Flame test). The F1506 performance standard also includes standard test ASTM 1959 ("Standard Test Method for Determining the Arc Thermal Performance Value of Materials for Clothing"), which measures the level of protection that the fabric provides against electrical arc exposure. The ASTM 1959 test establishes four levels of electrical arc protection as measured by the fabric's Arc Thermal Performance Value (ATPV), expressed in cal/cm$^2$: Level I is 4 cal/cm$^2$; Level II is 8 cal/cm$^2$; Level III is 25 cal/cm$^2$; Level IV is 40 cal/cm$^2$. At least Level II certification (ATPV greater than 8.0 cal/cm$^2$) is required for clothing worn by many electrical utility workers. ASTM F1506 also has minimum performance specifications for tensile breaking strength (40 pounds) and tear-resistance (4.0 pounds) of the fabric under standard test conditions, as well as a maximum allowable 3% shrinkage in both the warp and fill directions.

The NFPA 2112-2012 specification's notable requirements include a maximum 4-inch char length (both before and after 100 industrial launderings) and a maximum 10% thermal shrinkage.

In addition to the above-noted performance specifications of fabrics, other properties are also important if a fabric is to be practical and commercially viable, particularly for clothing. For instance, the fabric should be durable under repeated industrial launderings and should have good abrasion-resistance. Furthermore, the fabric should be readily dyeable to dark, solid shades of color, and should be comfortable to wear.

BRIEF SUMMARY OF THE INVENTION

More particularly, the present invention provides a fiber blend, a yarn made from the fiber blend, and a fabric made from the yarn, wherein the fiber blend comprises a blend of staple fibers comprising non-FR cellulosic fibers, modacrylic fibers, and aramid fibers intimately blended together. The blend is such that the cellulosic fibers constitute at least about 45 wt. % of the fiber blend, a weight ratio of the modacrylic fibers to the cellulosic fibers is at least 0.8 but not exceeding 1.0, and the aramid fibers make up no more than 15 wt. % of the fiber blend.

In one embodiment, the fiber blend comprises about 45 wt. % to about 50 wt. % of the cellulosic fibers, about 38 wt. % to about 45 wt. % of the modacrylic fibers, and about 10 wt. % to about 15 wt. % of the aramid fibers. In particular embodiments, the aramid fibers are para-aramid fibers.

In further particular embodiments, the cellulosic fibers comprise synthetic cellulosic fibers.

A yarn in accordance with one embodiment of the invention comprises the above-noted fiber blend spun into yarn. The yarn can be spun in various ways, including ring spinning, air jet spinning, and open-end spinning.

A fabric in accordance with one embodiment of the invention has a weight of about 4.0 oz./yd.$^2$ to about 10.5 oz./yd.$^2$, more preferably about 6.5 oz./yd.$^2$ to about 9.0 oz./yd.$^2$. The fabric can be woven (e.g., a woven twill or plain weave) or knitted. The invention also provides clothing made from the fabric.

The fabric in accordance with the invention is dyeable to dark or solid shades because the fiber blend is at least 85 percent dyeable. More specifically, the modacrylic fibers are dyeable with basic dyes, and the cellulose fibers are dyeable with fiber-reactive or direct dyes. Only the para-aramid fibers are not dyeable, and they comprise less than 15 percent of the fiber blend such that they do not interfere with the attainment of solid shades. Additionally, the fiber blend preferably does not include any other fiber types that would require dye procedures and/or processing conditions that would be incompatible with the fiber constituents of the blend. For example, the blend preferably does not include meta-aramid fibers because they require dye bath temperatures greater than 230° F. and the use of a carrier that reacts negatively with modacrylic.

The invention also provides a method for making a flame-resistant fabric, comprising the steps of forming an intimate blend of fibers comprising about 45 wt. % to about 50 wt. % cellulosic fibers, about 38 wt. % to about 45 wt. % modacrylic fibers, and about 10 wt. % to about 15 wt. % para-aramid fibers, wherein a weight ratio of the modacrylic fibers to the cellulosic fibers is at least 0.8 but not greater than 1.0; forming the blend of fibers into yarn; and knitting or weaving the yarn to form fabric.

In another embodiment of the invention, the method further comprises the steps of dyeing the fabric with basic dye to dye the modacrylic fibers, and dyeing the fabric with fiber reactive or direct dye to dye the cellulosic fibers. The dyeing steps preferably are carried out by exhaust dyeing at a dye bath temperature not exceeding about 230° F. Preferably, the fabric is first dyed with the basic dye, and then the fabric is dyed with the fiber reactive or direct dye. Optionally, a dye fixative can be used to fix one or more of the dyes.

The fabric made in accordance with the invention has an advantageous combination of properties. The fabric is able to pass the ASTM F1506 and NFPA 2112-2012 specification, and in fact can achieve a char length of less than 2.5 inches, well under the 4-inch maximum permissible value according to the NFPA 2112-2012 specification. This is a surprising result in view of the inclusion of an equal or greater content of cellulosic (non-FR) fibers relative to the modacrylic fibers. Additionally, the fabric can achieve NFPA 70E Level II certification for protection against electrical arc exposure. This is achievable with relatively low fabric weights such that clothing made of the fabric is perceived as being comfortable to wear; the inclusion of the synthetic cellulosic fibers provides softness and moisture wicking, which further aids the comfort. The para-aramid is included for its inherent flame-resistant properties, strength, and very low shrinkage even with repeated industrial launderings. The cellulosic content also allows the optional application of a resin to the fabric for further shrinkage control, if desired or needed in a particular instance. Furthermore, the fabric is over 85 percent dyeable such that dark, solid shades can be achieved.

DETAILED DESCRIPTION OF PREFERRED EMBODIMENTS

The present inventions now will be described more fully hereinafter with reference to particular embodiments and examples of the inventions. However, these inventions may be embodied in many different forms and should not be construed as limited to the embodiments set forth herein; rather, these embodiments are provided so that this disclosure will satisfy applicable legal requirements.

As used herein, "non-FR cellulosic fiber" means any fiber consisting of or made from vegetable source(s) and not treated to be flame-resistant. As used herein, "non-FR synthetic cellulosic fiber" means any "non-FR cellulosic fiber" that is not naturally occurring but is manufactured from vegetable sources. Non-FR synthetic cellulosic fibers can include but are not limited to lyocell (a regenerated cellulose fiber made from dissolving bleached wood pulp, one brand of which is TENCEL®), rayon (a regenerated cellulose fiber, one brand of which is MODAL®), acetate, and the like.

The present invention is the result of a development program spanning a substantial period of time and involving designs and trials of fabrics made from various yarn blends that include multiple fiber types including modacrylics, cellulosics, nylon, and para-aramids. Early work focused on blends such as 45% modacrylic/40% cotton/10% para-aramid/5% nylon. This achieved limited success with respect to the pertinent properties sought for the present invention, so additional development work was performed based on the early results.

Thus, follow-on work focused on blends such as 35% modacrylic/28% cotton/20% para-aramid/15% nylon/2% anti-static. Again, there was limited success. The development then shifted to a higher modacrylic content: 50% modacrylic/25% cotton/20% nylon/5% para-aramid, as disclosed for example in U.S. Patent Application Publication No. 2006/0292953. Fabric in accordance with this blend was developed for use in military combat uniforms.

A next-generation military blend for improved durability and comfort was sought. Multiple sample products were produced with combinations of various fibers. Fibers evaluated included modacrylics, nylon, para-aramids, antistatic fibers, BASOFIL® (heat resistant fiber based on melamine chemistry), FR polyester, ULTEM® (amorphous polyetherimide (PEI)), Lenzing FR® (synthetic cellulosic), TENCEL® (synthetic cellulosic), and others.

The optimized blend at that time (38% modacrylic/30% para-aramid/15% tencel/15% nylon/2% anti-stat) included TENCEL for comfort, hand, and moisture management, and nylon for improved strength and abrasion resistance.

Next, development work began on an improved dual-hazard (DH) blend, i.e., a blend capable of producing fabric that can meet both NFPA 2112 (flame-resistance) certification and NFPA 70E (arc flash protection) certification. The initial focus was on a blend comprising 45% para-aramid/45% TENCEL/10% nylon. Char length and thermal shrinkage were found not to be optimal, so development continued.

A first blend was modified to include modacrylic: (1) 45% modacrylic/45% TENCEL/10% para-aramid. A second blend was also considered: (2) 40% modacrylic/40% TENCEL/20% para-aramid. The nylon in the earlier blends was replaced with para-aramid to improve char length and thermal shrinkage. There were encouraging results with these blends (particularly blend (1)) relative to the earlier blends that included higher percentages of FR fibers. The inventors considered further increasing the percentage of non-FR fibers (particularly TENCEL), although it was thought that increasing the percentage of non-FR fibers above that of the FR modacrylic fibers would probably be counter-productive to flame-resistance. Nevertheless, further development of blends with higher non-FR content was conducted. Ultimately it was found that, surprisingly, a blend in accordance with the present invention, having more non-FR cellulosic content than modacrylic (FR) content, achieved the sought-after flame-resistance as well as the desired arc resistance, and also allowed the fabric to meet applicable requirements for thermal shrinkage and tear strength.

Table I below summarizes the results of fabric woven from three exemplary fiber blends. Samples 1 and 2 are not in accordance with the present invention. Sample 3 is in accordance with the present invention:

TABLE I

| TEST METHOD | PHYSICAL PROPERTIES | SAMPLE 1 Plain Weave warp yarn - 45/45/10 Protex M/Tencel/Nylon fill yarn - 45/45/10 Protex M/Tencel/Nylon | | SAMPLE 2 2 × 1 RH Twill warp yarn - 45/45/10 Protex M/Tencel/Nylon fill yarn - 45/45/10 Protex M/Tencel/Nylon | SAMPLE 3 2 × 1 LH Twill warp yarn - 48/40/12 Tencel/Protex M/Kevlar fill yarn - 48/40/12 Tencel/Protex M/Kevlar |
|---|---|---|---|---|---|
| ASTM D3774[1] | CUTTABLE WIDTH, in (finished) | 60.25 | 60.25 | 61.25 | 62.00 |
| ASTM D3776C[2] | WEIGHT, osy | 6.3 | 6.4 | 10.3 | 7.8 |
| ASTM D1424[3] | TEAR STRENGTH, lbf, w × f | 4.3 × 3.0 | 4.5 × 2.8 | 7.6 × 8.8 | 9.5 × 7.7 |
| ASTM D6413[4] | FLAME RESISTANCE, AFTERFLAME, sec, w × f | 0 × 0 | 0 × 0 | 0 × 0 | 0 × 0 |
| | FLAME RESISTANCE, CHAR LENGTH, in, w × f | 3.3 × 3.7 | 4.7 × 4.5 | 4.0 × 3.6 | 1.8 × 1.5 |
| ASTM D6413[4] | FLAME RESISTANCE, AFTERFLAME, sec, w × f AFTER 5 WASHES | DNT | 0 × 0 | DNT | 0 × 0 |
| | FLAME RESISTANCE, CHAR LENGTH, in, w × f AFTER 5 WASHES | DNT | 4.6 × 4.2 | DNT | 1.8 × 1.6 |
| NFPA 2112-2012[5] | THERMAL SHRINKAGE, %, w × f | 11.6 × 6.5 | 8.7 × 4.4 | 6.9 × 5.2 | 0.8 × 0.0 |
| NFPA 2112-2012[5] | THERMAL SHRINKAGE, %, w × f AFTER 5 WASHES | 9.8 × 6.3 | 9.0 × 5.8 | 6.5 × 6.7 | 0.3 × 2.3 |

[1]ASTM D3774 Standard Test Method for Width of Textile Fabric
[2]ASTM D3776C Standard Test Method for Mass Per Unit Area (Weight) of Fabric
[3]ASTM D1424 Standard Test Method for Tearing Strength of Fabrics by Falling-Pendulum Type (Elmendorf) Apparatus
[4]ASTM D6413 Standard Test Method for Flame Resistance of Textiles (Vertical Test)
[5]NFPA 2112-2012 Standard on Flame-Resistant Garments for Protection of Industrial Personnel Against Flash Fire The ASTM F1506 performance specification requires a fabric to meet the following criteria:

Afterflame duration: 2 seconds maximum

Breaking strength: 40 lbs. minimum

Tear-resistance: 4.0 lbs. minimum

Dimensional change: 3% maximum

ATPV≥8.0 cal/cm$^2$ for Arc Level II rating

Additionally, the NFPA 2112-2012 specification requires:

Char length: 4-inch maximum (before and after 100 industrial launderings)

Thermal shrinkage: 10% maximum

The flammability test according to standard ASTM D6413 entails vertically suspending a fabric sample measuring 12 inches long by 3 inches wide (with the length direction vertical) and igniting the lower end of the fabric and then removing the source of ignition. The duration of the afterflame following removal of the ignition source is measured in seconds, and the char length of the charred portion of the fabric is measured. The fabric is tested in both warp and fill directions (i.e., samples having the length direction parallel to the warp direction are tested and other samples having the length direction parallel to the fill direction are tested).

In the breaking strength test according to standard ASTM D5034, the fabric sample is put into a machine that grips the fabric with two clamps. One clamp is stationary and the other moves away at a controlled slow rate, thus applying tension until the fabric breaks or ruptures. The test is performed in both the warp and fill directions. The highest tensile load in pounds just at the moment the fabric breaks or ruptures is recorded.

The tear-resistance test according to standard ASTM D1424 measures the resistance of the fabric to tearing under a controlled force. The test indicates the material's resistance to tearing when there is an initial tear in the fabric. The fabric is tested in both warp and fill directions.

Fabric made from each type of yarn was also tested for electrical arc protection according to ASTM 1959. The Sample 1 fabric was tested to have an ATPV of 6.5 cal/cm$^2$. The Sample 2 fabric was tested to have an ATPV of 10.2 cal/cm$^2$. Thus, the heavier-weight Sample 2 met NFPA 70E Level II certification but the lighter-weight Sample 1 did not.

The Sample 3 fabric was tested to have an ATPV of 8.7 cal/cm$^2$, which meets the 70E requirement for a Level II fabric.

As the results in Table I indicate, in the flame-resistance test, the fabric made in accordance with the invention self-extinguished immediately and had a char length well below the maximum permissible 4 inches required to meet NFPA 2112-2012, even after five industrial launderings.

Indeed, the Sample 3 fabric had a char length of 1.8 inches after five launderings, and more generally fabrics made in accordance with the invention in other variations can achieve a char length of less than 2.5 inches.

Tear strength of the inventive fabric was far in excess of the minimum 4.0 pound level required. The inventive fabric achieved a thermal shrinkage well below the maximum permissible 10% even after extended industrial launderings.

In contrast, the Sample 1 and 2 fabrics not in accordance with the invention had char lengths that were either barely under the maximum allowable 4 inches or slightly in excess of 4 inches, and thus these fabrics were deemed to be unacceptable. Furthermore, comparing the tear strength of Sample 2 at 10.3 osy to that of the inventive Sample 3 at 7.8 osy, the Sample 3 tear strength is actually higher in the warp direction than for the heavier-weight Sample 2.

Thermal shrinkage of both Sample 1 and Sample 2 fabrics was far higher than that of Sample 3. Generally fabrics made in accordance with the invention can achieve a thermal shrinkage less than about 3.0% (versus the maximum permissible value of 10% per NFPA 2112-2012). Advantageously, achieving less than 3% thermal shrinkage allows the fabric to meet Canadian CGSB 155.20 certification.

The dyeability properties of the fibers are also important. An advantage of the fiber blend of the invention is that the chemicals and temperatures required for dyeing the various types of fibers do not interact negatively with each other. Advantageously, the fabric contains less than 15 percent of the para-aramid fibers (which are not dyeable), and thus is over 85 percent dyeable. Therefore, dark, solid shades can be achieved by dyeing each of the dyeable fiber types in the fabric. The dyes are all applied in an exhaust dyeing procedure. The preferred dye procedure is to dye the fabric (or the yarn from which the fabric is made) first with basic dyes to dye the modacrylic fibers. Next the fabric or yarn is dyed with fiber reactive or direct dyes to dye the cotton fibers. Finally, the fabric or yarn is dyed with acid or disperse dyes to dye the nylon fibers. The maximum temperature reached in the dye bath is not greater than 230° F. in each dyeing procedure. The modacrylic fibers cannot withstand temperatures greater than 230° F. Optionally, one or more dye fixatives can be used for fixing one or more of the dyes.

Alternatively, fabric with a heather appearance can be achieved by dyeing only some of the fiber types such as just the modacrylic fibers.

The invention is susceptible to numerous variations within the scope of the appended claims.

Fabric made in accordance with the invention may also be vat dye printable. The military has a nylon/cotton product that it uses for camouflage garments. The current military fabric is not fire-resistant. The fabric of the present invention may provide a fire-resistant fabric that is printable with a camouflage pattern.

Fiber blends in accordance with the invention can be made from fibers having various staple fiber lengths and various deniers. Suitably, the fibers can range in length from about 0.5 inch to about 2.5 inches. In the trials reported above, fiber lengths were in the 1.5 to 2.0 inch range. The modacrylic, cellulosic, and para-aramid fibers can have a denier ranging from about 0.5 to about 3.0. In the trials reported above, fiber deniers were in the 1.2 to 1.5 range. Yarns can be made in accordance with the invention in various sizes, as single-ply or two-ply yarn, although two-ply yarns are preferred for strength and durability. With respect to two-ply yarns, the yarns can vary in cotton count sizes from 64/2 to 15/2, more preferably from about 38/2 to 15/2. In the trials reported above, yarn sizes ranged from 18/2 for the heavier-weight fabrics to 34/2 for the lighter-weight fabrics. The yarns can be ring-spun, air jet-spun, or open-end-spun.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A flame-resistant intimate fiber blend of staple fibers comprising non-FR cellulosic fibers, modacrylic fibers, and aramid fibers intimately blended together, wherein:

the cellulosic fibers constitute at least 45 wt. % to at most 54 wt. % of the fiber blend;

the modacrylic fibers constitute at least 36 wt. % to at most 49 wt. % of the fiber blend, where a weight ratio of the modacrylic fibers to the cellulosic fibers is at least 0.8 but less than 1.0; and the aramid fibers make up at least 3 wt. % to at most 15 wt. % of the fiber blend.

2. The flame-resistant intimate fiber blend of claim 1, wherein the aramid fibers constitute para-aramid fibers.

3. The flame-resistant intimate fiber blend of claim 2, wherein the non-FR cellulosic fibers comprise non-FR synthetic cellulosic fibers.

4. The flame-resistant intimate fiber blend of claim 3, wherein the blend comprises:

45 wt. % to 50 wt. % of the cellulosic fibers;

38 wt. % to 45 wt. % of the modacrylic fibers; and wt. % to 15 wt. % of the para-aramid fibers.

5. The flame-resistant intimate fiber blend of claim 3, wherein the blend comprises:

45 wt. % to 50 wt. % of the cellulosic fibers;

38 wt. % to 42 wt. % of the modacrylic fibers; and 10 wt. % to 15 wt. % of the para-aramid fibers.

6. A flame-resistant fabric constructed from yarns spun from the intimate fiber blend of claim 1, the fabric having a weight of 4.0 oz./yd$^2$ to 10.5 oz./yd$^2$.

7. The flame-resistant fabric of claim 6, having a weight of 6.5 oz./yd$^2$ to 9.0 oz./yd$^2$.

8. The flame-resistant fabric of claim 6, wherein the fabric is woven.

9. The flame-resistant fabric of claim 6, wherein the fabric has an average char length less than 2.5 inches when tested in accordance with ASTM D6413.

10. The flame-resistant fabric of claim 6, wherein the fabric has a thermal shrinkage less than 3.0% when tested in accordance with NFPA 2112-2012.

11. A garment constructed from the flame-resistant fabric of claim 6.

12. A method of making a flame-resistant fabric, comprising the steps of:

forming an intimate blend of staple fibers, the staple fibers comprising non-FR cellulosic fibers, modacrylic fibers, and aramid fibers, wherein:

the cellulosic fibers constitute at least 45 wt. % to at most 54 wt. % of the fiber blend;

the modacrylic fibers constitute at least 36 wt. % to at most 49 wt. % of the fiber blend, where a weight ratio of the modacrylic fibers to the cellulosic fibers is at least 0.8 but less than 1.0; and the aramid fibers make up at least 3 wt. % to at most 15 wt. % of the fiber blend;

spinning the blend of staple fibers into yarn; and knitting or weaving the yarn to form fabric.

13. The method of claim 12, further comprising the steps of:

dyeing the modacrylic fibers with basic dye; and dyeing the cellulosic fibers with fiber reactive or direct dye.

14. The method of claim 13, further comprising using a dye fixative to fix the dyes.

15. The method of claim 12, comprising weaving the yarn in a twill pattern to form the fabric.

16. The method of claim 12, wherein the spinning step comprises open-end spinning the blend of staple filers into yarn.

17. The method of claim 12, wherein the spinning step comprises ring spinning the blend of staple fibers into yarn.

18. The method of claim 12, wherein the spinning step comprises air jet spinning the blend of staple fibers into yarn.

19. The method of claim 12, further comprising the step of calendaring the fabric to reduce air permeability of the fabric.

20. A yarn formed from a blend of staple fibers comprising non-FR cellulosic fibers, modacrylic fibers, and aramid fibers intimately blended together, wherein:

the cellulosic fibers constitute at least 45 wt. % to at most 54 wt. % of the fiber blend;

the modacrylic fibers constitute at least 36 wt. % to at most 49 wt. % of the fiber blend, where a weight ratio of the modacrylic fibers to the cellulosic fibers is at least 0.8 but less than 1.0; and the aramid fibers make up at least 3 wt. % to at most 15 wt. % of the fiber blend.

21. The yarn of claim 20, wherein the yarn is ring-spun.

22. The yarn of claim 20, wherein the yarn is air jet-spun.

23. The yarn of claim 20, wherein the yarn is open-end spun.

* * * * *